US008402796B2

(12) United States Patent
Han et al.

(10) Patent No.: US 8,402,796 B2
(45) Date of Patent: Mar. 26, 2013

(54) LAUNDRY MACHINE HAVING FIRST AND SECOND LAUNDRY TREATING SPACES

(75) Inventors: Dong Joo Han, Gyeongsangnam-do (KR); In Ho Cho, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 449 days.

(21) Appl. No.: 12/432,471

(22) Filed: Apr. 29, 2009

(65) Prior Publication Data

US 2010/0089099 A1 Apr. 15, 2010

(30) Foreign Application Priority Data

Apr. 30, 2008 (KR) ..... 10-2008-0040599

(51) Int. Cl.
*D06F 33/00* (2006.01)
*D06F 29/00* (2006.01)

(52) U.S. Cl. ..... 68/13 R; 68/20

(58) Field of Classification Search ..... 68/3 R, 68/12.02, 12.23, 13 R, 15, 20
See application file for complete search history.

(56) References Cited

U.S. PATENT DOCUMENTS

| | | | | |
|---|---|---|---|---|
| 6,671,978 | B1 * | 1/2004 | McGowan et al. | 34/596 |
| 6,928,752 | B2 * | 8/2005 | Johnson et al. | 34/595 |
| 2004/0134237 | A1 * | 7/2004 | Sunshine et al. | 68/3 R |
| 2004/0154194 | A1 * | 8/2004 | Prows | 38/14 |
| 2004/0194339 | A1 * | 10/2004 | Johnson et al. | 34/595 |
| 2005/0138835 | A1 * | 6/2005 | Lyu et al. | 34/596 |
| 2005/0140506 | A1 * | 6/2005 | Oh et al. | 340/538 |
| 2005/0155393 | A1 * | 7/2005 | Wright et al. | 68/3 R |
| 2006/0090524 | A1 * | 5/2006 | Jeon et al. | 68/135 |
| 2006/0112585 | A1 * | 6/2006 | Choi et al. | 34/73 |
| 2006/0150689 | A1 * | 7/2006 | Kim et al. | 68/236 |
| 2006/0225301 | A1 * | 10/2006 | Lyu et al. | 34/595 |
| 2006/0225302 | A1 * | 10/2006 | Lyu et al. | 34/595 |
| 2007/0119072 | A1 | 5/2007 | Kim | |
| 2007/0151305 | A1 | 7/2007 | Kendall et al. | |
| 2007/0151306 | A1 | 7/2007 | Gilboe et al. | |

FOREIGN PATENT DOCUMENTS

| | | | |
|---|---|---|---|
| CA | 1235467 | | 4/1988 |
| DE | 42 28 469 | A1 | 5/1993 |
| EP | 0747523 | | 12/1996 |
| EP | 1 233 100 | A1 | 8/2002 |
| EP | 1 524 356 | A1 | 4/2005 |
| JP | 01145099 | A * | 6/1989 |
| SU | 211514 | | 9/1970 |
| WO | WO 2008/013411 | A2 | 1/2008 |

* cited by examiner

*Primary Examiner* — Joseph L Perrin
(74) *Attorney, Agent, or Firm* — Birch, Stewart, Kolasch & Birch, LLP

(57) ABSTRACT

A laundry machine includes a first laundry treatment apparatus, second laundry treatment apparatus including an air supply unit, a first course selection part for a user to select a treating course for the first laundry treatment apparatus, and a second course selection part provided together with the first course selection part, the second course selection part for the user to select a treating course for the second laundry treatment apparatus.

6 Claims, 5 Drawing Sheets

LAUNDRY MACHINE HAVING FIRST AND SECOND LAUNDRY TREATING SPACES

CROSS REFERENCE TO RELATED APPLICATION

This application claims the benefit of the Korean Patent Application No. 10-2008-0040599, filed on Apr. 30, 2008, which is hereby incorporated by reference as if fully set forth herein.

BACKGROUND OF THE DISCLOSURE

1. Field of the Disclosure

The present invention relates to a laundry machine.

2. Discussion of the Related Art

Generally, laundry machines are home appliances that are used to clean laundry by washing and drying laundry, using detergent and mechanical friction. Laundry machines are categorized into washing machines, dryers and single appliances performing both washing and drying functions.

SUMMARY OF THE DISCLOSURE

The present invention is directed to a laundry machine.

An object of the present invention is to provide a laundry machine with enhanced laundering efficiency, and which has an improved overall exterior appearance.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry machine includes a cabinet; a partition partitioning inner space of the cabinet into first treating space for main treatment of laundry and second treating space for auxiliary treatment of laundry; a first course selection part provided in either of the first and second treating space, the first course selection part for a user to select a treating course for the laundry inside the first treating space; a second course selection part provided in either of the first and second treating space together with the first course selection part, the second course selection part for the user to select a treating course for the laundry inside the second treating space; and a single power supply applying the power to a driving part operating the treating course of the first treating space and a driving part operating the treating course of the second treating space.

The laundry machine may further includes a drum rotatable within the first treating space; and a air supply unit detachably supplying air to the second treating space. Here, wherein the first course selection part may allow the user to select a course for the drum and the second course selection part may allow the user to select a course for the air supply unit.

At least one of a supply time of air and a temperature of the supplied air are may be preset different in each course of the air supply unit.

At least one of air conditions preset in a selected course of the air supply unit may be changeable by the user' operation of the second selection part.

The laundry machine may further include a display part displaying information on the treating course of the first treating space and information on the treating course of the second treating space.

While the laundry is treated in either of the first and second treating space by the user's operation of either of the first and second course selection part, the other course selection part may stop operation.

In case the first and second course selection parts are selected randomly, either of the first and course selection parts selected later may be memorized.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure.

In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts. A configuration of a laundry machine a control method according to this embodiment may be applicable to will be described first and a control method of the laundry machine will be described later.

Figure 1:
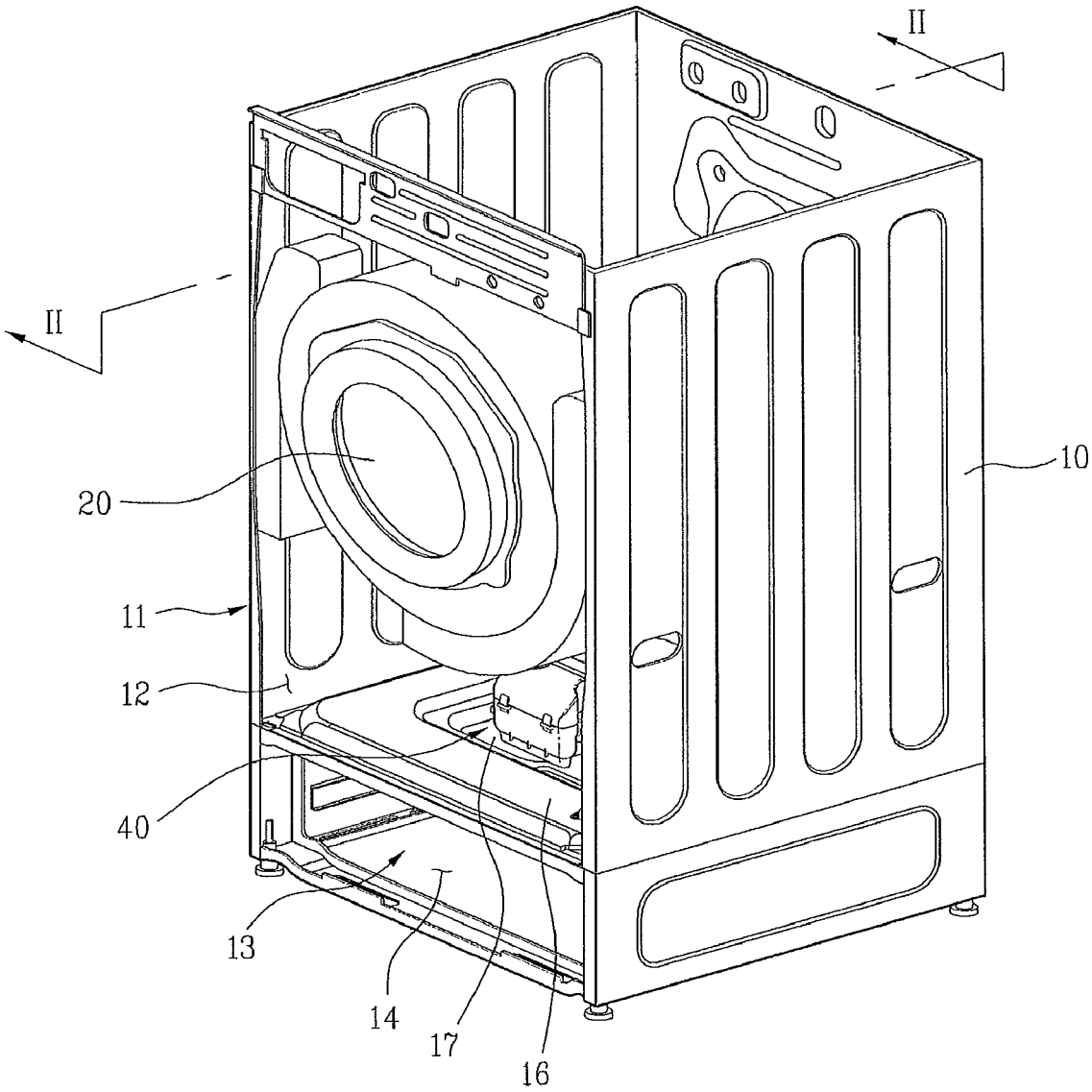
FIG. 1 is a perspective view illustrating a laundry machine according to an exemplary embodiment of the present invention.
Figure 2:
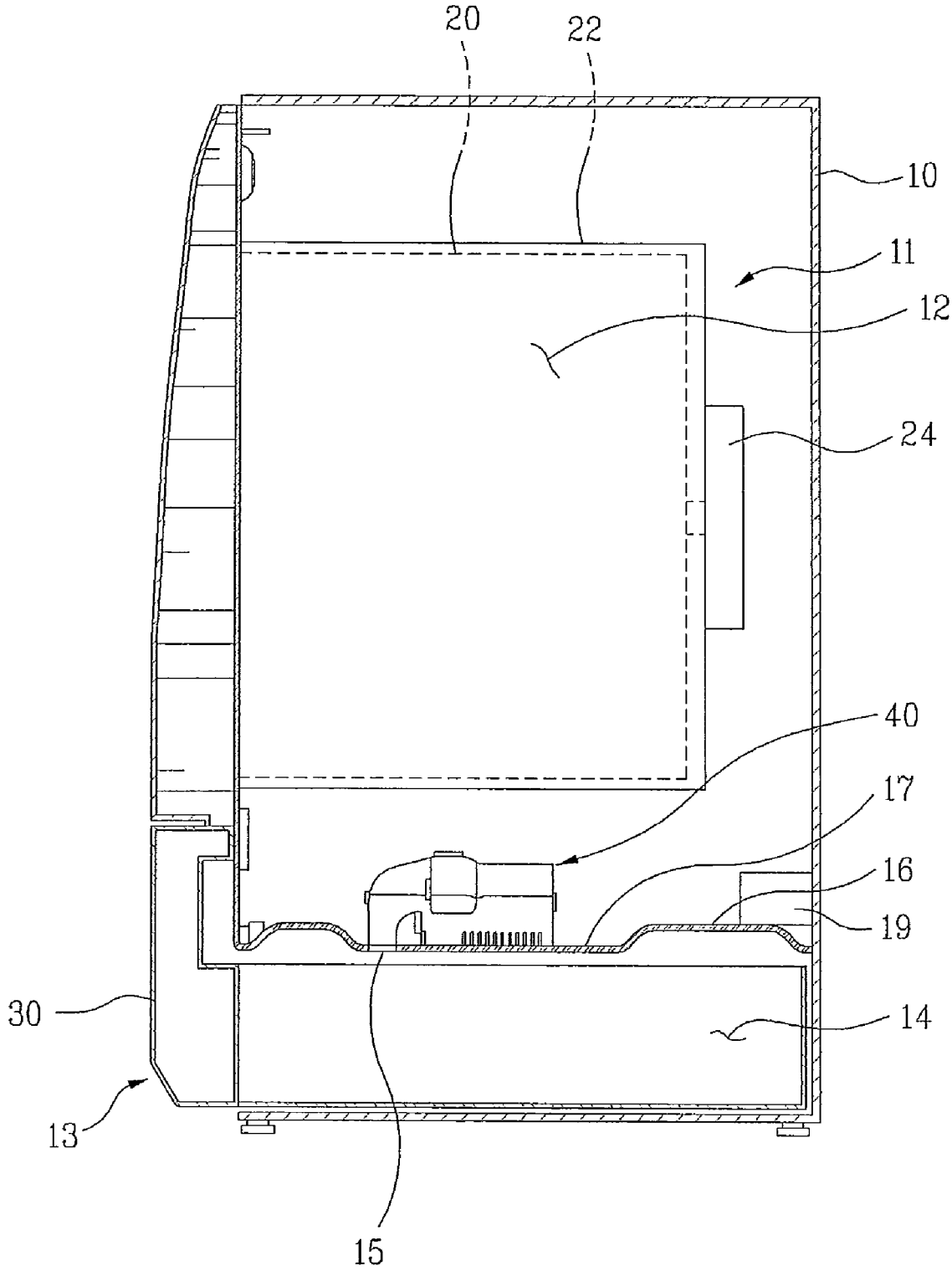
FIG. 2 is a sectional view illustrating line shown in FIG. 1.

Referring to FIGS. 1 and 2, a laundry machine includes a first laundry treatment apparatus 11 and a second laundry treatment apparatus 13. The first laundry treatment apparatus 11 and the second laundry treatment apparatus 13 may be provided in a cabinet 10.

More particularly, the first laundry treatment apparatus 11 defines a first laundry treatment space 12, and the second laundry treatment apparatus 13 defines a second laundry treatment space 14.

Main laundry treatment for the laundry may be performed in the first space 12. The first laundry treatment apparatus 11 may include a laundry washing apparatus or a laundry drying apparatus. Auxiliary laundry treatment for the laundry may be performed in the second space 14.

Here, the above main laundry treatment may mean conventional washing and/or drying operations, and auxiliary laundry treatment may mean additional drying or refreshing operations for the laundry, or may mean drying or refreshing operations for small-sized laundry. The term 'refreshing' may mean a process of removing wrinkles, deodorizing, sanitizing, preventing static electricity, or warming the laundry by supplying air, heated air, steam, mist or water to the laundry. The term 'laundry' may include not only clothes but also all kinds of wearable objects and apparel such as shoes, socks, gloves and hats. Thus, laundry means all kinds of laundry to which laundering operations can be performed.

The cabinet 10 defines an exterior appearance of the laundry. Various components may be mounted in the cabinet 10. A rotatable drum 20 may be provided in the first laundry treatment space 12 inside the cabinet 10, and a detachable drawer 30 may be provided in the second treating space 14. The drum 20 and the drawer 30 are each configured to receive laundry therein. If the laundry machine is configured as a washing machine or a single appliance having both washing and drying functions, a tub 22 for accommodating wash water may be further provided, and the drum 20 may be provided within the tub 22. The drawings show a laundry machine including a tub as an example.

The cabinet 10 may be formed of two separate members to include the first laundry treatment apparatus 11 and the second laundry treatment apparatus 13. More particularly, the cabinet 10 may included a pair of first sidewalls at opposing sides of the first laundry treatment apparatus 11, and a pair of second sidewalls at opposing sides of the second laundry treatment apparatus 13, the pair of first sidewalls being contiguous with the pair of second sidewalls.

Figure 3:
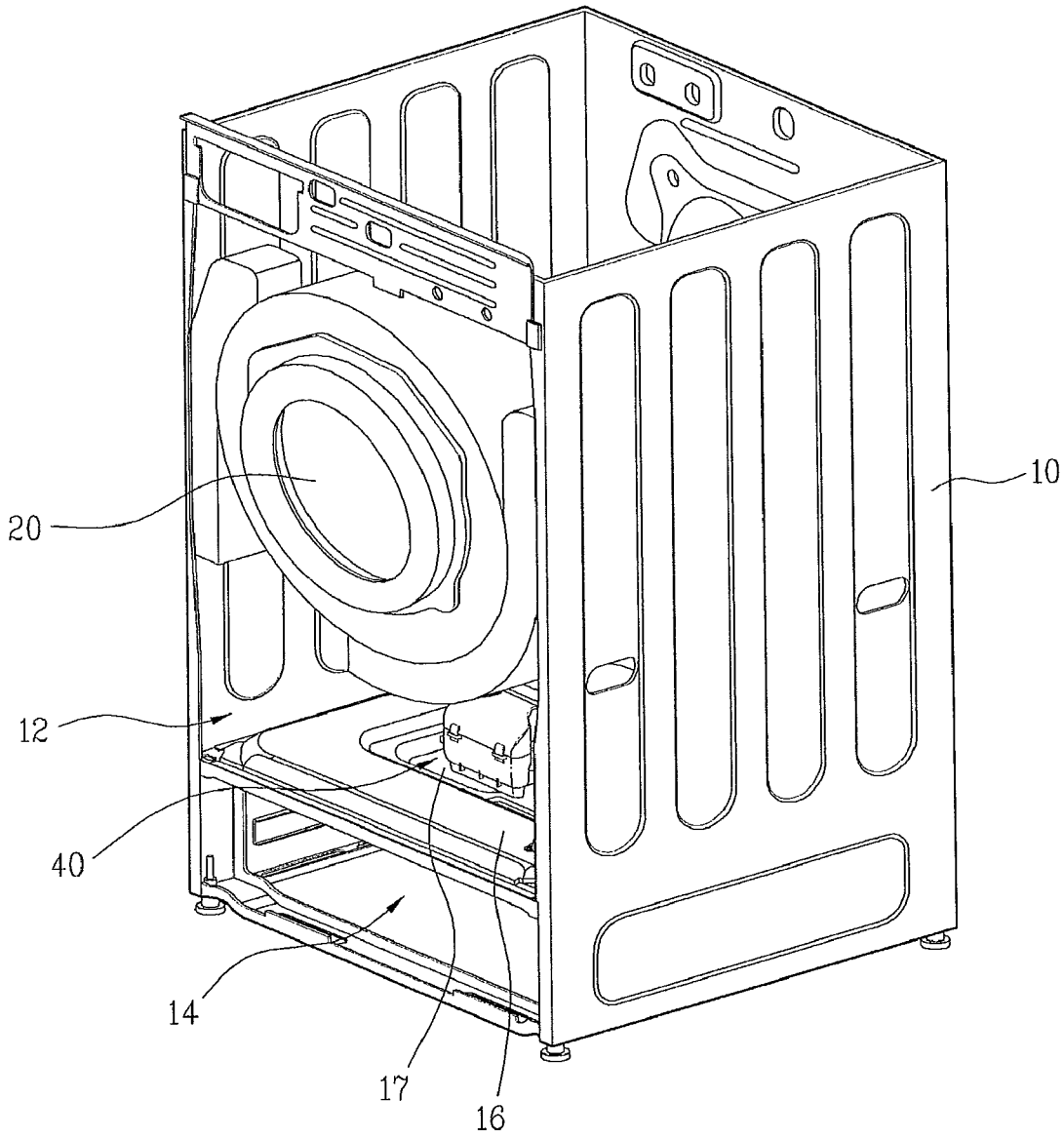
FIG. 3 is a perspective view illustrating a laundry machine according to another exemplary embodiment of the present invention

Alternatively, the cabinet 10 may be formed of a single member. In one embodiment, the first laundry treatment apparatus 11 and the second laundry treatment apparatus 13 are provided within the cabinet 10 formed of a single member. More particularly, the cabinet 10 may include a first sidewall and a second sidewall, each of the first and second sidewalls extending continuously and uninterrupted from the first laundry treatment apparatus 11 to the second laundry treatment apparatus 13, as shown, for example, in FIG. 3.

A partition 16 may be provided in the cabinet 10. The partition 16 may be a single partition. The single partition 16 may partition the cabinet 10 into the first laundry treatment apparatus 11 and the second laundry treatment apparatus 13. If the first laundry treatment apparatus 11 and the second laundry treatment apparatus 13 are formed in the cabinet 10 formed of the single member, the assembly work of the cabinet 10 will be simple and the necessary time for assembly will be reduced accordingly.

According to the washing machine of this embodiment, the cabinet 10 formed of a single member includes the first laundry treatment apparatus 11 and the second laundry treatment apparatus 13, and it further includes the partition 16 which partitions the cabinet 10 into the first laundry treatment apparatus 11 and the second laundry treatment apparatus 13. The partition 16 may be embodied as a wall located within the cabinet 10 that extends between the first sidewall and the second sidewall. The partition 16 divides the inner space horizontally into an upper space corresponding to the first space 12 and a lower space corresponding to the second space 14. However, the present invention is not limited to the above.

That is, according to this embodiment, the cabinet 10 includes the partition 16 which is simultaneously employed as a base of the first laundry treatment apparatus 11 and as a top cover of the second laundry treatment apparatus 13. More particularly, the partition 16 has a first side and a second side, the first side being exposed to the first laundry treatment space 12, and the second side being exposed to the second laundry treatment space 14. Because the single partition 16 is employed as the base of the first laundry treatment apparatus 11 and the top cover of the second laundry treatment apparatus 13, the assembly work will be remarkably simple and the time necessary for the assembly work will be reduced, compared with a case of including a separate base of the first laundry treatment apparatus 11 and a separate top cover of the second laundry treatment apparatus 13. The provision of a single partition 16, as compared to a separate partition for each of the first and second laundry treatment apparatuses 11, 13, provides a simple structure for the laundry machine as a whole, and provides a good overall appearance to the laundry machine. In addition, the use of a single partition 16 simplifies assembly, and reduces costs due to the reduction in necessary material as compared with the use of separate partitions. Finally, a single partition 16 permits effective utilization of the first and second laundry treatment apparatuses 11, 13, and ease of access to the first laundry treatment apparatus 13.

In addition, the laundry machine may further include the air supply unit 40 for supplying air or heated air to the second laundry treatment space 14 of the second laundry treatment apparatus 13.

The air supply unit 40 may be provided in the first space 12 and it is envisioned that the air supply unit is provided at a top surface of the partition 16.

The partition 16 includes an aperture 15 therein so that air is supplied through the partition 16 and into the second laundry treatment space 14 of the second laundry treatment apparatus 13. The air supply unit 40 includes an air outlet that may be directly connected to the aperture 15 in the partition 16. The aperture 15 is located in a central portion of the partition.

The rotatably oriented drum 20 may be provided within the first laundry treatment space 12 of the first laundry treatment apparatus 11. The drawer 30 may be provided within the second laundry treatment space 14 of the second laundry treatment apparatus 13. The volume of the first space 12 may be substantially larger than the volume of the second space 14. As a result, to utilize the inner space efficiently, it is envisioned that the air supply unit 40 is provided in the first space 12, rather than in the second space 14. Such an arrangement permits the amount of interior volume of the second space 14 available to receive laundry to be maximized.

In addition, providing the air supply unit 40 outside of the second space 14 simplifies the structure of the second laundry treatment apparatus 13 and provides more freedom of design of the second laundry treatment apparatus 13. Finally, because the interior of the second space 14 is readily accessible by a user via the drawer 30, placing the air supply unit 40 in an area other than the second space 14 provides an additional level of safety for the user.

The arrangement of the air supply unit 40 in the first laundry treatment space 12 with the air being supplied through the aperture 15 in the partition 16 provides a mainly downwardly-directed airflow into the second laundry treatment space 14.

This downwardly-directed airflow is particularly beneficial for drying or treating shoes 100, because the air is provided downwardly to the upper of the shoe 100 to envelope the upper of the shoe 100 with the airflow, in contrast to a horizontal airflow which may only be directed at one side of a shoe, or an upwardly directed airflow which would be blocked by the sole of the shoe.

In addition, the downwardly-directed airflow is directed toward the bottom of the drawer and then will tend to spread out in all directions, providing well distributed air flow and reducing possible dead zones with little or no airflow in the drawer 30.

More particularly, the drawer 30 includes a bottom wall and a plurality of sidewalls that define an enclosed space having an open top side. The height of the sidewalls may be less than the width and depth dimensions of the drawer 30 so that the outlet of the airflow from the air supply unit 40 is relatively close to the bottom of the drawer so that the drawer bottom tends to redirect the downwardly-directed airflow outwardly in all directions. The drawer bottom and the plurality of side walls may be configured to prevent air from passing therethrough so as to maximize the amount of air that is redirected upwardly.

However, it is envisioned that the drawer bottom and/or the drawer sidewalls may include one or more apertures, such as a series of small ventilation holes, mesh or screening, to permit some of the airflow to pass therethrough.

The air supply unit 40 may be detachably provided on the partition 16, and more particularly, on the upper side of the partition 16. Here, a recess portion 17 may be provided on the partition 16 to accommodate the air supply unit 40. More specifically, a central portion of the partition 16 includes a recessed portion (or recess) 17 extended downwardly in an upper side of the partition 16.

The drum 20 is positioned in the first space 12 above the partition 16, and therefore it is possible that water may fall on the partition 16 because of the rotation of the drum during a washing, rinsing or drying-spinning cycle. As a result, the recess portion 17 may also collect the water falling onto the partition 16. In addition to that, the recess portion 17 accommodates the air supply unit 40. As a result, although not shown in the drawings, a water drainage structure may be provided at a predetermined portion of the recess portion 17 to drain the collected water without contacting the air supply unit 40. Alternatively, a bottom surface of the recess portion 17 may slope enough so that the collected water does not flow toward the air supply unit 40.

In reference to FIG. 2, the air supply unit 40 may be provided on the partition 16, and it can supply heated air to the second space 14. Specifically, the air supply unit 40 heats air from inside the first space 12 of the cabinet 10 and supplies the heated air to the second space 14. Here, the air inside the first space 12 will flow downwardly toward the second space 14 after being heated by the air supply unit 40. The downwardly-directed airflow is directed toward the bottom of the second space 14 and then will tend to spread out in all directions, providing well distributed air flow and reducing possible dead zones with little or no airflow in the second space 14.

Thus, the first space 12 forms a predetermined space where air is drawn into the air supply unit 40, that is, an air drawing space, and the second space 14 forms a predetermined space where air inside the air supply unit 40 is discharged, that is, an air discharging space. From a view of the air supply unit 40, the first space 12 is positioned on an air drawing path and the second space 14 is positioned on an air discharging path. As a result, an auxiliary inlet or outlet path for the air supply unit 40 does not have to be provided. The air supply unit 40 is configured to supply the air into the second laundry treatment space 14 without passing through the drum 20.

An aperture 15 forming a heated air inlet is provided in the partition 16 and the heated air by the air supply unit 40 is supplied to the second treatment space 14 via the aperture 15.

A single power supply 19 is provided in the cabinet 10 and the single power supply 19 applies power to the laundry machine. Specifically, the single power supply 19 applies the power to the first laundry treatment apparatus 11 and the second laundry treatment apparatus 13 via a wire (not shown) or the like. More particularly, the single power supply 19 applies the power to a driving part for the first laundry treatment apparatus 11 and a driving part for the second laundry treatment apparatus 13. The driving part for the first laundry treatment apparatus 11 is corresponding to a motor 24 rotating the drum 20 and the driving part for the second laundry treatment apparatus 13 is corresponding to the air supply unit 40.

In the meanwhile, the drawer 30 may be detachable from a front lower portion of the cabinet 10. Although not shown in the drawings, the laundry machine may further include a deodorization filter for removing undesirable smell of the laundry used one or two times or a fragrance addition unit (not shown) supplying fragrance to the drawer 30.

Figure 4:
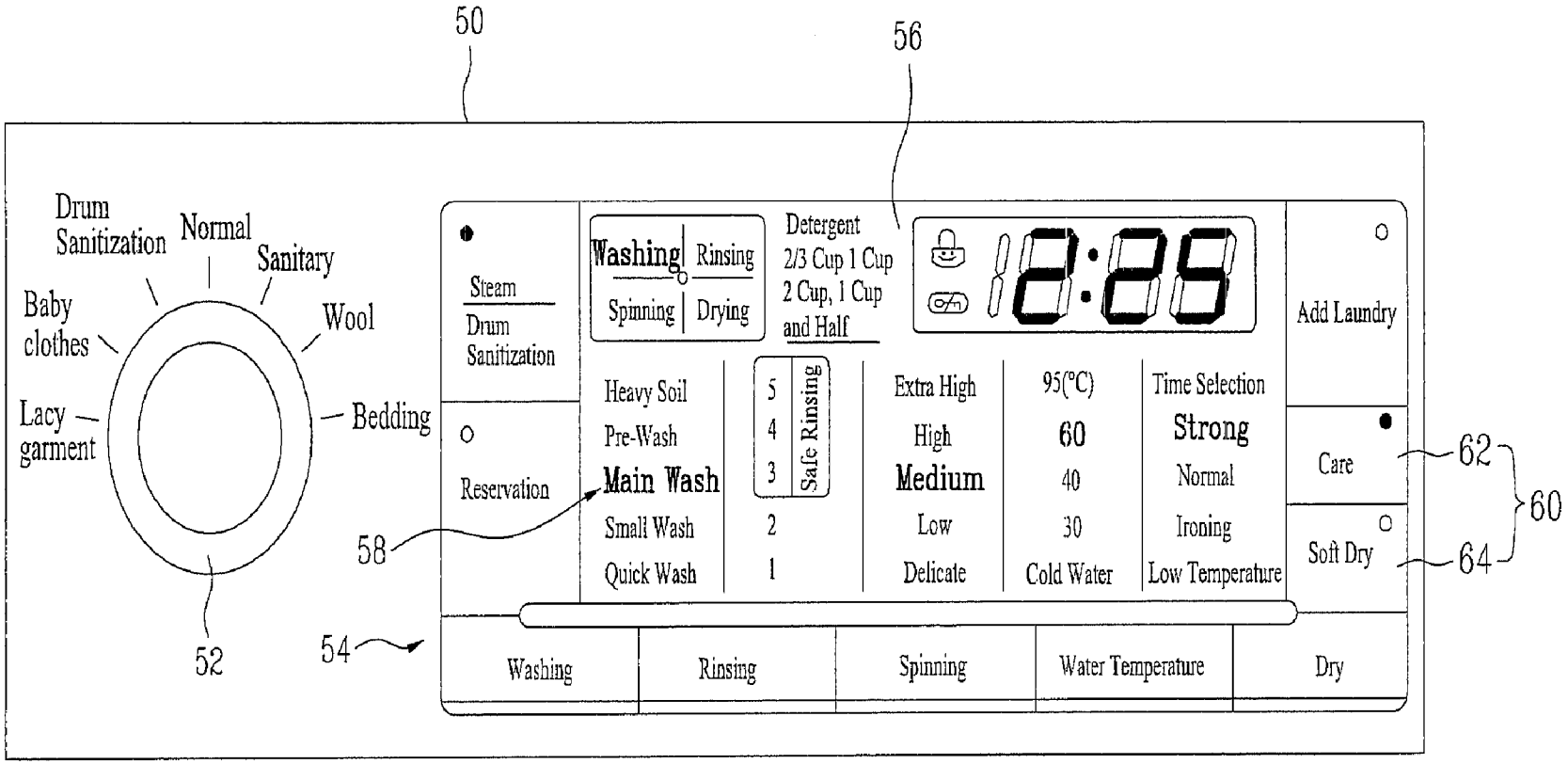
FIG. 4 is a front view illustrating a control panel according to an embodiment of the present invention, which is provided in the laundry machine of FIG. 1.

FIG. 4 is a front view illustrating a course selection part applicable to the laundry machine of FIG. 1.

The laundry machine according to this embodiment may include a course selection part for a user to select a laundry treatment courses for the laundry. User can select laundry treatment courses for the laundry inside the first laundry treatment apparatus 11, that is, a drum course via the course selection part. User also select laundry treatment courses for the laundry inside the second laundry treatment apparatus 13, that is, a air supply unit course via the course selection part. Plural course selection parts may be provided in the first treating space 12 and the second treating space 14, respectively. Here, it is envisioned for the user's operational convenience sake that the course selection part is provided in either of the first laundry treatment apparatus 11 and second laundry treatment apparatus 13 together.

In case the course selection parts for both the first and the second laundry treatment apparatuses 11 and 13 are provided in either of the two apparatuses, a control panel 50 may be provided together with. It is envisioned that the control panel 50 is provided in an upper portion of the first laundry treatment apparatus 11 such that the user selects operations without bending his or her waist.

Specifically, a first course selection part 50 is used for selecting one of various courses of the drum 20, for example, underwear, baby clothes, standard, sheet course and the like. Here, the laundry machine may further include a main display part 56 for displaying operation information of the first laundry treatment apparatus 11 to the user. The main display part 56 may also display operation information of the second laundry treatment apparatus 13. This main display part 56 will be described in detail later.

The laundry machine may further include an additional selection part 54 allowing the user to change an operational condition of a washing, rinsing, spinning and/or drying cycle included in a selected course. In case the user pushes each button of the additional selection part 54, user can change the kind of washing, the times of rinsing, the rpm of the spinning, the water temperature and the like. If the condition for each cycle is adjusted, the adjusted condition of each cycle may be displayed in an additional display part 58 which will be described later.

The second course selection part 60 allows the user to select an operation course of the second laundry treatment apparatus 13, i.e., the air supply unit 40. Here, at least two operation courses may be provided. The number of the courses is not limited and it may be adjustable appropriately.

The second course selection part 60 may include a care course selection part 62 and a soft dry course selection part 64. In addition, conditions of the air supplied to the second laundry treatment space 14 by the air supply unit 40 may be preset different in each of the courses. For example, at least one of the temperature of the air and the supply time of the air supplied by the air supply unit 40 is preset different in the care course and from in the soft dry course. Since the soft course may be selected to dry delicate laundry, the supply time and the temperature of the air in the soft course may be longer and higher than in the care course.

Specifically, the care course may be selected to dry laundry. In case the care course is selected, the air may be supplied for preset 40 minutes, for example. In case the user pushes the care course selection part 62 repeatedly, the air supply time may be changed sequentially, for example, 40, 90, 130 and 40 minutes.

The soft dry course may be selected to dry delicate laundry such as underwear, for example, lacy garments. In case the soft dry course is selected, the air may be supplied for preset 30 minutes, for example. In case the user pushes the soft dry course selection part 64 repeatedly, the air supply time may be changed sequentially, for example, 30, 60, 120 and 30 minutes.

In the meanwhile, the temperature of the air supplied in each course may be adjusted in case the user pushes each course selection part repeatedly. The user can select a suitable course according to the kind of the clothes the user wishes to dry appropriately.

The main display part 56 and the additional display part 58 may be provided in the control panel 50. The main display part 56 displays information on an operational state of the first laundry treatment apparatus 11 and information on the second laundry treatment apparatus 13.

Specifically, the main display part 56 is provided in a predetermined portion of the control panel 50. The main display part 56 displays the information on first laundry treatment apparatus 11, i.e., the drum 20, for example, a title of the selected course or the remaining time of the operation of the selected course. Furthermore, the main display part 56 displays the information on the second laundry treatment apparatus 13, i.e., the air supply unit 40, for example, the temperature of the air or the remaining time of the air supply.

The additional display part 58 displays specific information on each cycle of each course of the drum 20. The user can adjust operational conditions of the cycles included in each course by using the additional selection part 54. The operation conditions may include the kind of washing, the number of rinsings, the rotation speed of the spinning and the temperature of wash water for a washing, rinsing, spinning and drying cycle. If adjusting the operation conditions for each cycle as mentioned above, the additional display part 58 may display the adjusted condition of each course.

As mentioned above, the laundry machine applies electricity to the motor 24 and the air supply unit 40 by using the single power supply 19 (see FIG. 2). In this case, there may be applicable electric current permission limit according to an installation place, a national policy, a country rule or national law with respect to the laundry machine. If the first laundry treatment apparatus 11 and the second laundry treatment apparatus 13 are operated simultaneously with the above legal electricity permission limit, the required electric currents for the operation of both apparatuses would exceed the allowable value of the electric currents. In this case, it is envisioned that the first laundry treatment apparatus 11 and the second laundry treatment apparatus 13 are not operated simultaneously.

As a result, if one of the first laundry treatment apparatus 11 and the second laundry treatment apparatus 13 is operated, the other is not operated. For that, if the drum 20 is put into operation in the first laundry treatment apparatus 11 by the user's selection of the first course selection part 52, it is envisioned that the second course selection part 60 is deactivated even by the user's selection operation, and vice versa.

Figure 5:
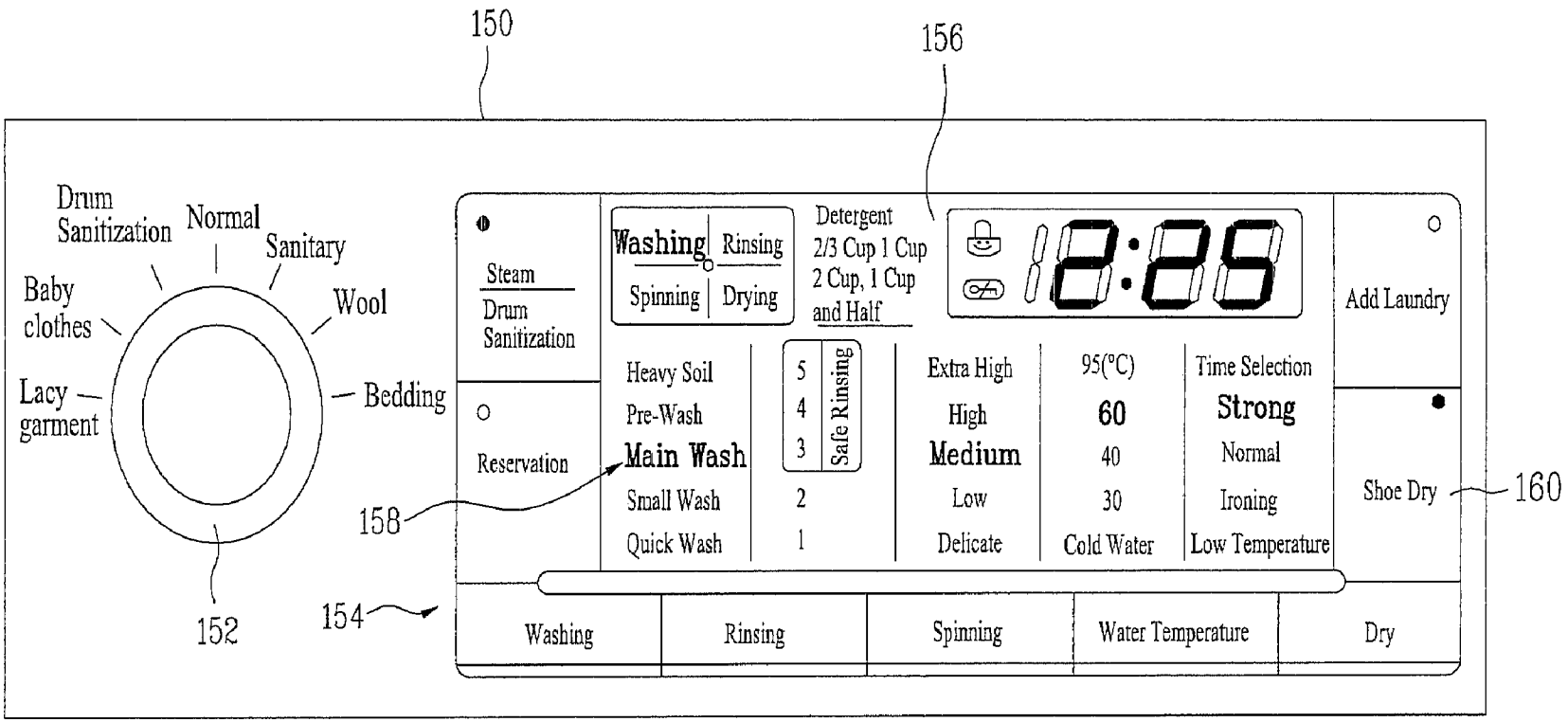
FIG. 5 is a front view illustrating a control panel according to another embodiment of the present invention.

FIG. 5 is a front view illustrating a control panel 150 according to another embodiment that is able to be installed in the laundry machine shown in FIG. 1.

Compared with the above embodiment, this embodiment presents a single second course selection part 160 for selecting courses of the air supply unit 40. This different configuration will be described in detail.

Referring to FIG. 5, a control panel 150 according to this embodiment includes a second course selection part 160 which includes a single course selection part, for example, a shoes dry course selection part.

For example, in case the user puts shoes to dry in the drawer 30, the user may select the shoes dry course selection part 160. Here, shoes may be categorized based on a kind of shoes material into leather shoes and non-leather shoes, for example, sneakers. It is envisioned that the user may select a leather shoes dry course or non-leather shoes dry course. Specifically, the user may push the shoes dry course selection part 160 repeatedly to select the leather shoes dry course and the non-leather shoes dry course sequentially.

Generally, leather shoes are susceptible to heat, compared to non-leather shoes. If dried beyond a predetermined temperature, the leather shoes would be deformed or damaged. As a result, the temperature of the air supplied in the leather shoes dry course is relatively lower than in the non-leather shoes dry course. The supply time of the air in the leather shoes dry course is relatively shorter than in the non-leather shoes dry course.

In the meanwhile, the above embodiment presents that the control panel is mounted in the upper portion of the front surface of the cabinet and the present invention is not limited thereto. For example, the control panel may be mounted in a front surface of the drawer.

Therefore, the laundry machine described above includes the control panel having the selection part for selecting the courses of the air supply unit. As a result, an auxiliary control panel does not have to be provided in the laundry machine according to the present invention and the operation of the air supply unit may be controlled smoothly and conveniently.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry machine comprising:

a cabinet;

a first space where washing and drying are performed;

a second space where drying is performed, the second space being located below the first space;

a single partition wall partitioning inner space of the cabinet into the first space and the second space;

a first laundry treatment apparatus provided in the first space;

a drum rotatable within the first laundry treatment apparatus;

a second laundry treatment apparatus provided in the second space;

an air supply unit provided in the first space, the air supply unit supplying air from the first space to the second space independent of the first laundry treatment apparatus;

a control panel configured to select courses for both the first laundry treatment apparatus and the second laundry treatment apparatus;

a first course selection part provided at a predetermined portion of the control panel, the first course selection part for a user to select a treating course for the first laundry treatment apparatus; and a second course selection part provided at another predetermined portion of the control panel together with the first course selection part, the second course selection part for the user to select a treating course for the second laundry treatment apparatus, wherein the first course selection part allows the user to select a course for the drum and the second course selection part allows the user to select a course for the air supply unit, wherein the second laundry treatment apparatus includes a drawer able to be drawn forwardly from a front side of the cabinet, and wherein the control panel is provided in an upper portion of the cabinet forming the first space.

2. The laundry machine of claim 1, further comprising:

a single power supply for applying the power to the first laundry treatment apparatus and the second laundry treatment apparatus.

3. The laundry machine of claim 1, wherein at least one of air conditions preset in a selected course of the air supply unit is changeable by the user's operation of the second course selection part.

4. The laundry machine of claim 1, further comprising:

a display part displaying information on the first laundry treatment apparatus and the second laundry treatment apparatus.

5. The laundry machine of claim 1, wherein while the laundry is treated in either of the first laundry treatment apparatus and the second laundry treatment apparatus, the course selection part of the other laundry treatment apparatus is deactivated.

6. The laundry machine of claim 1, wherein the air supply unit does not supply air to the first space.

* * * * *